US009194665B2

(12) United States Patent
Schade et al.

(10) Patent No.: US 9,194,665 B2
(45) Date of Patent: Nov. 24, 2015

(54) OPTIMIZED BENT BAR GRILLE

(71) Applicant: BAE Systems Land & Armaments, L.P., Santa Clara, CA (US)

(72) Inventors: David Arthur Schade, Belmont, CA (US); Dennis Jenks, Gilroy, CA (US); Adrienne Bourque, San Jose, CA (US); Ron Cabreros, Salinas, CA (US); Jaime Alforque, Salinas, CA (US); Adonis Kassinos, San Jose, CA (US)

(73) Assignee: BAE Systems Land & Armaments, L.P., Santa Clara, CA (US)

( * ) Notice: Subject to any disclaimer, the term of this patent is extended or adjusted under 35 U.S.C. 154(b) by 0 days.

(21) Appl. No.: 14/202,650

(22) Filed: Mar. 10, 2014

(65) Prior Publication Data

US 2014/0251120 A1 Sep. 11, 2014

Related U.S. Application Data

(60) Provisional application No. 61/775,195, filed on Mar. 8, 2013.

(51) Int. Cl.

| | |
|---|---|
| ***F41H 7/04*** | (2006.01) |
| ***F41H 5/02*** | (2006.01) |
| ***F41H 7/03*** | (2006.01) |

(52) U.S. Cl.

CPC ..... *F41H 7/035* (2013.01)

(58) Field of Classification Search

CPC ... F41H 7/035; B60R 19/52; B60R 2019/525; B60R 2019/527

USPC ..... 89/36.02, 36.04, 36.07, 36.08, 36.09; 109/49.5; 454/141, 142, 194, 237, 241, 454/277, 279, 281; 293/115; 180/68.6

See application file for complete search history.

(56) References Cited

U.S. PATENT DOCUMENTS

| | | | | |
|---|---|---|---|---|
| 3,042,555 | A * | 7/1962 | George et al. | 148/439 |
| 3,802,850 | A * | 4/1974 | Clougherty | 428/547 |
| 4,325,283 | A * | 4/1982 | Bemiss | 89/36.07 |
| 4,788,915 | A * | 12/1988 | Sauvestre | 102/439 |
| 4,936,400 | A * | 6/1990 | Blumbach et al. | 180/68.1 |
| 4,962,710 | A * | 10/1990 | Habicht et al. | 109/79 |
| 5,149,910 | A * | 9/1992 | McKee | 89/36.02 |
| 5,749,140 | A * | 5/1998 | Polito et al. | 29/527.1 |
| 6,405,630 | B1 * | 6/2002 | Gonzalez | 89/36.02 |
| 6,672,195 | B1 | 1/2004 | Plattner | |
| 2007/0028759 | A1 * | 2/2007 | Williams | 89/36.09 |
| 2012/0240757 | A1 | 9/2012 | Schade et al. | |

FOREIGN PATENT DOCUMENTS

| | | |
|---|---|---|
| KR | 10-2000-038452 | 7/2000 |
| KR | 10-2008-0055226 | 6/2008 |
| KR | 10-2009-0017063 | 2/2009 |

OTHER PUBLICATIONS

International Search Report and Written Opinion from related PCT Application PCT/US2014/022662, dated Jul. 8, 2014, 4 pgs.

* cited by examiner

*Primary Examiner* — Bret Hayes

(74) *Attorney, Agent, or Firm* — Patterson Thuente Pedersen, P.A.

(57) ABSTRACT

An optimized grille design that narrows the louver pitch and narrows the louver construction so as to maintain the air flow through the grille. An aerodynamic shape is applied to the leading edge of the louver thus lowering drag and reducing the pressure drop at the inlet.

17 Claims, 5 Drawing Sheets

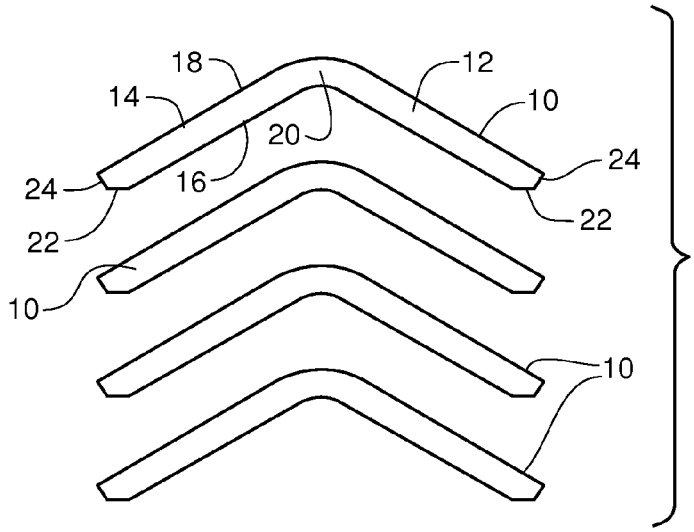
Fig. 5
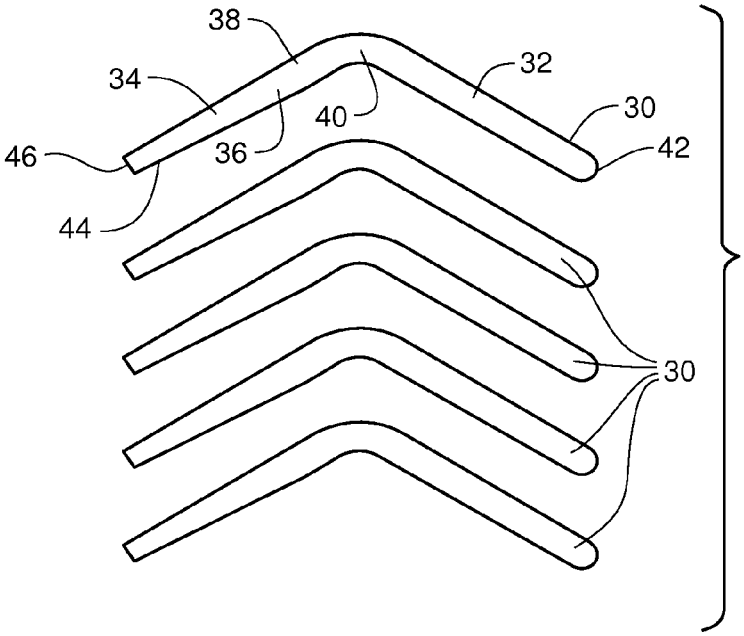
Fig. 6
Fig. 7
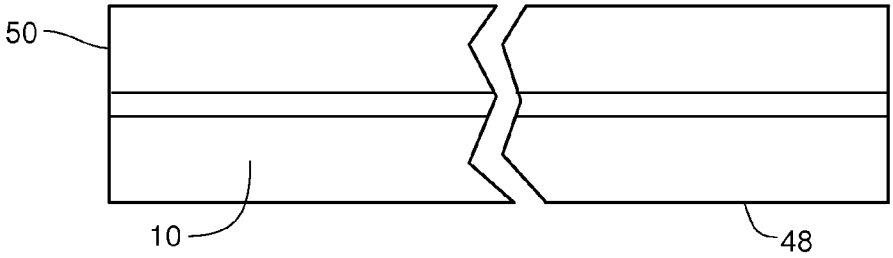

OPTIMIZED BENT BAR GRILLE

RELATED APPLICATION

The present application claims the benefit of U.S. Provisional Application No. 61/775,195 entitled "OPTIMIZED BENT BAR GRILLE", filed Mar. 8, 2013, which is incorporated herein by reference in its entirety.

FIELD OF THE INVENTION

The present invention generally describes a grille for vehicles and more specifically a design for a ballistic grille for armored vehicles.

BACKGROUND OF THE INVENTION

Ballistic grilles are used to provide protection as well as airflow. Openings for air flow through the grille inherently create protection problems for the occupants of the vehicle. In order to provide protection, the grille must be made of materials to withstand threats so that projectiles do not enter the vehicle. This makes grilles comparatively heavier but not as well protected as the rest of vehicles armor. Bars or louvers of existing grilles may slow or catch a threat, but because they are open they may not fully stop a penetrator, spall or small fragments that may break off and pass thru the openings to impact crew or components behind the grille.

In the prior art, aluminum S-shaped louvers formed grilles, which were used to provide protection for intake and exhaust vents on armored vehicles. Grille armor has consisted of louvers, typically in a chevron or S shape. Made of aluminum or steel, the louvers are spaced to provide a circuitous open path that air can flow through. Projectiles that fly in a straight line are stopped by contact with the louvers. However, thick louvers block airflow or create stagnation points which affect engine performance.

Current grilles by themselves do not provide sufficient protection against high velocity artillery threats. But spacing or pitch of the existing grill leaves sections of the grille fairly open, so that threats don't hit much of the grille. Thus, there is a tradeoff between the desired protection and desired air flow.

Recently development has focused on an existing grille which uses 3" high×0.25" thick 4130 steel louvers. The bars are bent at 60 degrees and spaced 1" apart. When baseline ballistic test and flow models were done it was determined that the grille itself may not be sufficient.

The earlier designs have not worked to maximize the airflow while maintaining protection. A grille design is needed that allows airflow with minimal pressure drops. Air flow is affected by spacing between the bars, width of the bars, and dimensions along the width of the bars. The objective is to create a new grille which improves ballistic protection, reduces pressure drop and maintains flow volume over existing steel bent bar grille.

SUMMARY OF THE INVENTION

The present invention is for a ballistic grille which uses shaped metal bars. The bar shape is improved for better air flow and ballistic protection. The bars may be of steel or other comparable material that can withstand the expected threats.

This grille design uses a closer pitch louver or bar to create more interference with threats. But, it uses thinner bars so that the percent open area for air flow remains the same. Flow modeling shows that the pressure drop and mass flow through the closer pitch grille is the same as with existing designs. Modeling flow profiles show high velocity and high pressure drop at the square openings of the grille. Chamfering or breaking the square corner at the inlet/opening yielded an additional 30% reduction in pressure drop.

The present invention may include adding an aerodynamic feature, such as rounding, chamfering, slanting, beveling or other means to change the traditional square end of the inlet end of the louver. In a first embodiment, chamfering at both ends of the louver may be provided. In the first embodiment, louvers are 0.1875" thick at a pitch of 0.7585". The chamfer 22 is 0.06"@45° just on the inner edge. The bend angle at the vertex is 60°, and the overall height is 3". Chamfering may be needed only at the inlet end. Alternatively, the louver may have rounding at the inlet and a taper to the outlet to further reduce pressure drop. In the second embodiment, the bar would remain 0.1875" thick. Removing the material of the round and lower taper removes mass from the bar. To keep the same area density, the pitch could be reduced to 0.7192". This would increase the overlap between bars, improving ballistics. Drag coefficient tables for straight bars indicate the drag coefficient at approximately 1. Drag coefficients for a rounded entry and tapered exit are approximately 0.5.

The revised configuration may use 4130 steel or Class 2 RHA (MIL-DTL-12560). But metals with higher strength and toughness would have higher ballistic performance. Earlier testing showed materials with a high Figure of Merit (Area under stress strain curve (elongation *(yield+ultimate)/2) have higher ballistic performance than 4130 steel. Inconel 625 was the best material in these tests but other materials that have been demonstrated to perform or should perform well include, 304 Stainless Steel, and High Nickel Steels like Armox® 440, Armox® 500, Mars 220, and Mars 250, HY 100 steel.

Another material option would to use a heat treatable steel and selectively treat different parts of the bar to different hardness. The tip of the bar could be harder, Rc 50, to initially induce projectile shattering or more erosion as the round enters the grille. The back of the bar could remain softer, Rc 25 to 30, and tougher to better catch projectiles, and be less prone to having small fragments break off of it.

Another embodiment would be for a grill using the reduced pitch, thinner bar with a rounded inlet and a tapered outlet which uses an improved material like front hardened or Inconel 625 grille bars.

In an embodiment, the pitch between louvers is equal to the width of the louver, the louver width defined as the perpendicular distance from the louver vertex to a line connecting the tips of the inlet side arm and the outlet side arm.

In an embodiment, the pitch between louvers is less than the width of the louver, the louver width defined as the perpendicular distance from the louver vertex to a line connecting the tips of the inlet side arm and the outlet side arm.

In an embodiment the overlap between louvers is equal to or greater than the thickness of the louver at the vertex.

The present invention also includes a method for defeating a ballistic threat to an airhandling grille of a vehicle. The method comprises attaching a ballistic grille with a plurality of shaped metal louvers to the vehicle, positioning the plurality of louvers disposed within the grille, said louvers mounted in parallel across the length of the grille frame so that the ballistic threat must strike the louvers, wherein the louvers have an inlet side arm and an outlet side arm, the inlet side arm corresponding to the direction of a threat and the outlet side arm closer to the vehicle; and setting a pitch between louvers that is less than the width of the louver, the louver width defined as the perpendicular distance from the louver vertex to a line connecting the tips of the inlet side arm and the outlet side arm.

The method may also include the inlet side arm having an aerodynamically shaped leading edge. The aerodynamically shaped leading edge being a chamfered end. Alternatively, said aerodynamically shaped leading edge being a rounded end. The outlet side arm may also include a chamfer face or a tapered side.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

FIG. 5 is a side view of one embodiment of a plurality of louvers having chamfer.

FIG. 6 is a side view of another embodiment of a plurality of louvers having round inlet and tapered outlet.

FIG. 7 is a broken planar view of a louver.

Figure 1:
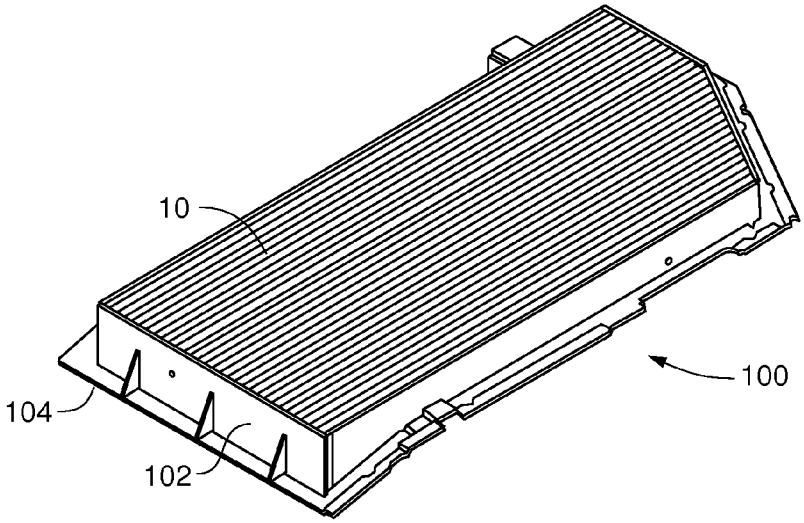
FIG. 1 is a perspective view one embodiment of an exhaust grille for an armored vehicle.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE DRAWINGS

Figure 2:
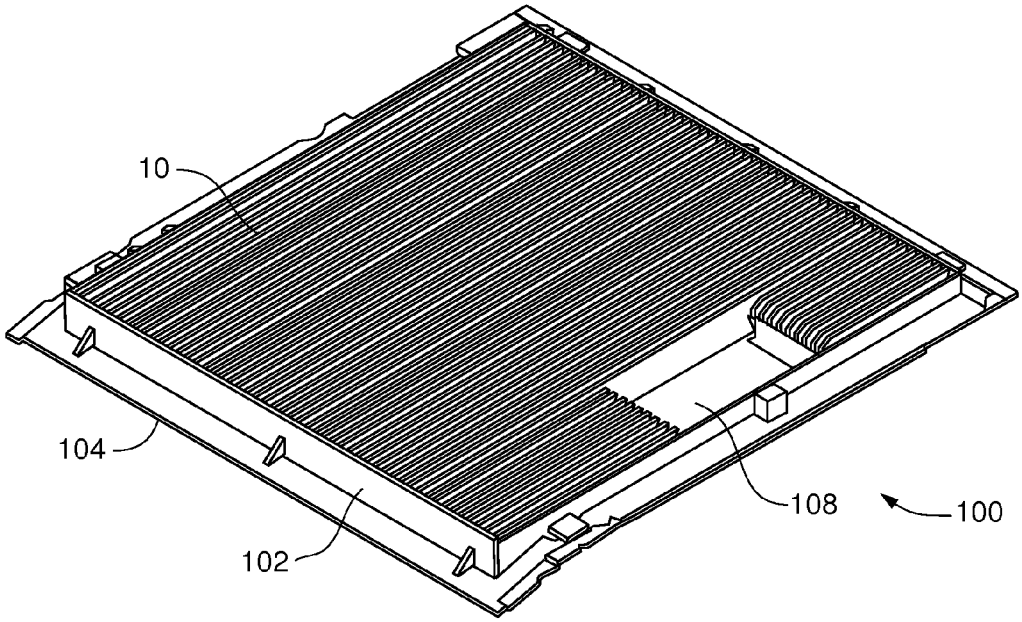
FIG. 2 is a perspective view of an embodiment of an intake grille for an armored vehicle.
Figure 3:
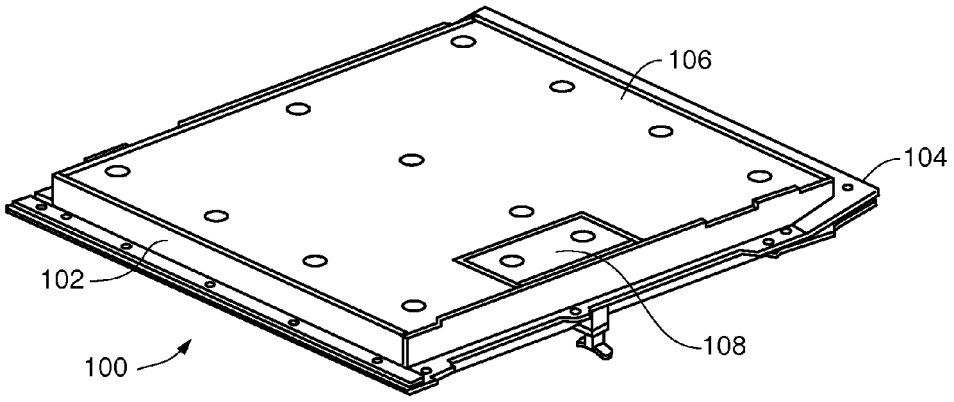
FIG. 3 is a perspective view of the underside of the intake grille for the armored vehicle of FIG. 2.
Figure 4:
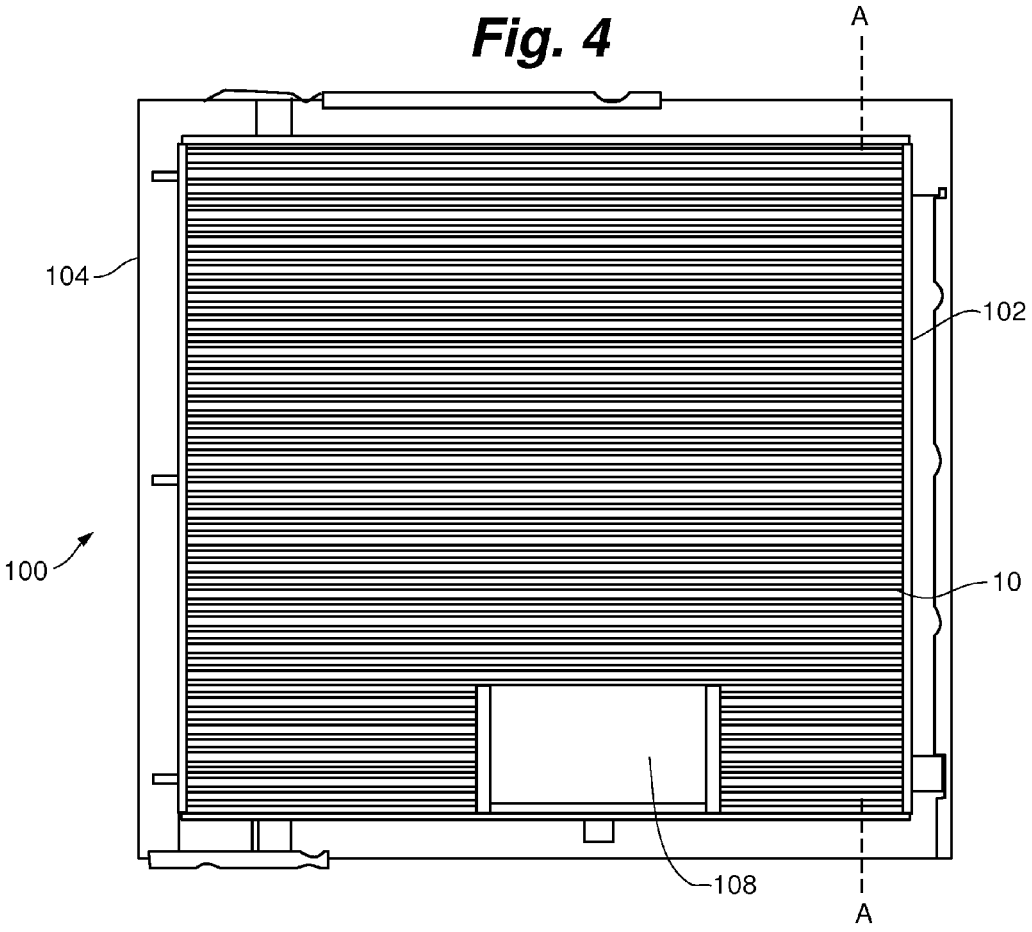
FIG. 4 is a planar view of the armored grille of FIG. 2.

Referring generally to FIGS. 1-12, in one embodiment, grille 100 comprises a plurality of louvers 10. FIGS. 1-4 depict various grille 100 structures depending on the required use. FIG. 1 is a perspective view one embodiment of an exhaust grille for an armored vehicle. FIG. 2 is a perspective view of an embodiment of an intake grille for an armored vehicle. FIG. 3 is a perspective view of the underside of the intake grille for the armored vehicle of FIG. 2. FIG. 4 is a planar view of the armored grille of FIG. 2. Louvers 10 are disposed within a grille frame 102. The grille frame 102 is surrounded by a grill flange 104 which permits mounting of the grille 100 within an armored vehicle. A honeycomb structure 106, as shown in FIG. 3, maybe positioned on the interior face of the grille structure 104 to provide additional protection to the interior components and or personnel. Typically, the grille structure 102 will include an access section 108 so that grille frame 102 can be removed.

The louvers 10 generally extend from a first end of the grille frame 102 to the opposing second end of the grille frame 102. The louvers 10 are spaced in a parallel with each other across the grille frame 102. In this application the term pitch is used to denote the spacing of the louvers relative to each other. For example, in the prior art, louvers were spaced approximately 1" apart. In the present application, the louver pitch is closer based on the design of the louvers 10.

In one embodiment, each of the plurality of louvers 10 may be composed of aluminum, steel, rolled homogenous armour (RHA), heat treatable steel, polymer, or other comparable material that can withstand the explosions, fire, and other threats present in a combat zone. In one embodiment, the louvers 10 of grille 100 may be created using heat treatable steel.

In one embodiment, as depicted in FIG. 5, louver 10 is generally V-shaped and is formed as a single integral piece. Louver 10 comprises inlet side arm 12, outlet side arm 14, acute face 16, obtuse face 18 and vertex 20. The louvers 10 are positioned so that air can move between adjacent louvers 10 but that a projectile cannot move in a straight line between the louvers 10. As shown in FIGS. 5 and 6, vertex 20 is nested into the acute face 16 of the adjacent louver 10. The goal is to have any projectile strike at least one surface of the louver 10 while passing through the grill 100.

With respect to FIG. 5, louver 10 includes symmetrical inlet side arm 12 and outlet side arm 14. Both inlet side arm 12 and outlet side arm 14 include a chamfer face 22 and an end face 24. The chamfer face 22 is positioned on the acute face 16. The chamfer face 22 is angled to be parallel to the normal of the grille frame 102. In this embodiment, the inlet side arm 12 terminates at a square corner creating end face 24.

In one embodiment, the various portions of the louver 10 may be selectively treated to different hardness levels. In one embodiment, inlet side arm 12 may be selectively harder than the rest of the louver; for example, it could be hardened to approximately Rc 50. In one embodiment, outlet side arm 14 may be selectively softer than the inlet side arm 12; for example it could be hardened to approximately Rc 25 to approximately Rc 30. In operation, a selectively treated, harder inlet side arm 12 may induce more projectile shattering and erosion when a projectile enters the grille 100. In operation, a selectively treated, softer outlet side arm 14 may be better at catching projectiles and less prone to fragmentation.

The louvers 10, in a first embodiment, are 0.1875" thick at a pitch of 0.7585". The chamfer 22 is 0.06"@45° just on the inner edge. The bend angle at vertex 20 is 60°, and the overall height is 3". To insure consistent ballistic and flow performance, the tolerance of the grill pitch and thickness should be held to tight tolerances +0.005/−0.003 on the thickness. The louver 20 spacing may vary +/−0.01" between louvers, but the average spacing should be 0.7585" across the grille. Ballistic grilles 100 serve dual use as both armor and mobility components. Armor component tolerances may be 1/16", but mobility components are typically a few thousandths of an inch.

With respect to FIG. 6, louvers 30 comprise inlet side arm 32, outlet side arm 34, acute face 36, obtuse face 38 and vertex 40. The louvers 30 are again positioned so that air can move between adjacent louvers 30 but that a projectile cannot move in a straight line between the louvers 30. As shown in FIG. 6, vertex 40 is nested into the acute face 36 of the adjacent louver 30. The goal is to have any projectile strike at least one surface of the louver 30 while passing through the grill 100.

FIG. 6 includes asymmetrical inlet side arm 32 and outlet side arm 34. Inlet side arm 32 includes constant thickness that terminates at a rounded face 42. The outlet side arm 34 has a tapered thickness section 44 that terminates at an end face 46. The tapering occurs to the acute face 36. The end face 46 is perpendicular to obtuse face 38. In operation, the use of a rounded face 42 and tapered thickness section 44 yields additional pressure drops beyond the approximately 30% pressure drop created when using a square corner 24 as shown in FIG. 5. In operation, the rounded face 42 and tapered thickness section 44 creates a drag coefficient of approximately 0.5 as compared to a drag coefficient of 1 for straight bars. In FIG. 6, louver 30 has a thickness of approximately 0.1875" with a tolerance range of +0.005/−0.003. and the pitch of louvers 30 may be lowered from approximately 0.7585" to approximately 0.7192".

FIG. 7 depicts a louver 10 in planar view. The length 48 of louver 10 is dependent on the size of the grille 100. The width 50 in most applications in 3". The goal is obviously to minimize width while maintaining ballistic effectiveness.

Figure 8:
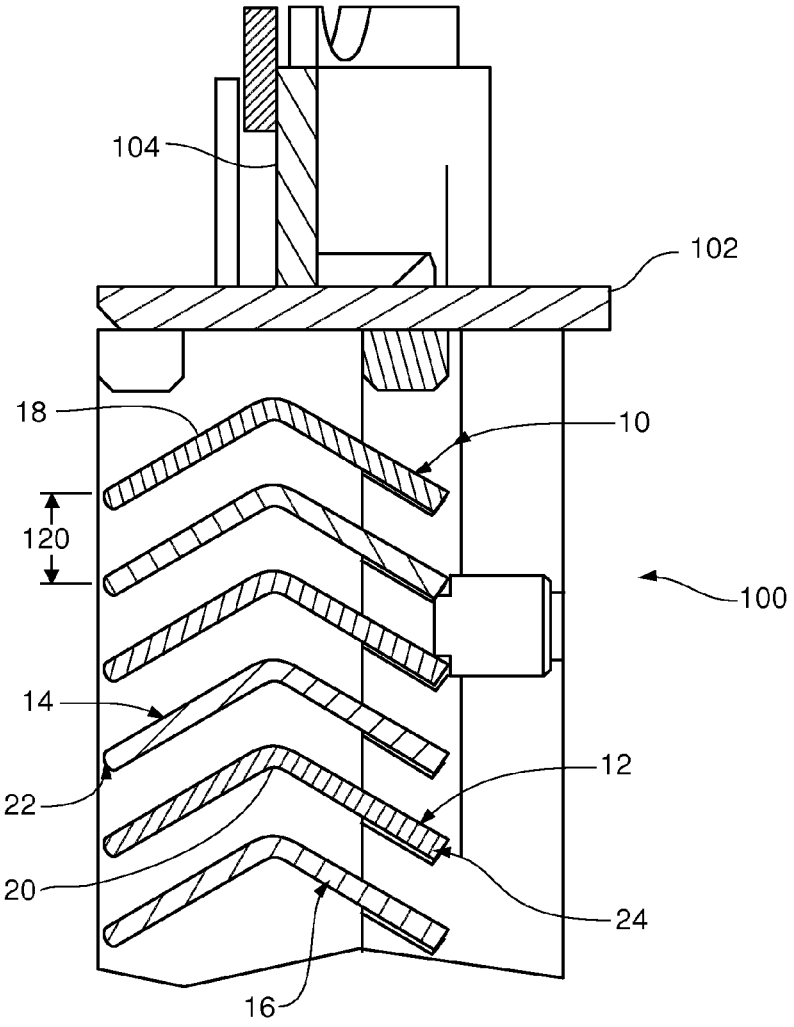
FIG. 8 is a cross sectional view of a plurality of louvers taken at A-A of FIG. 4.

FIG. 8 depicts a cross sectional view of a representative grille 100 of FIG. 4 taken at axis A-A. Louvers 10 are disposed within a grille frame 102. The grille frame 102 is surrounded by a grill flange 104 which permits mounting of the grille 100 within an armored vehicle. The louvers 10 appear in parallel alignment with pitch noted as 120. Louver 10 comprises inlet side arm 12, outlet side arm 14, acute face 16, obtuse face 18 and vertex 20. The louvers 10 are positioned so that air can move between adjacent louvers 10 but that a projectile cannot move in a straight line between the louvers 10. Louver 10 includes symmetrical inlet side arm 12 and outlet side arm 14. Both inlet side arm 12 and outlet side arm 14 include a chamfer face 22 and an end face 24. The chamfer face 22 is positioned on the acute face 16. The chamfer face 22 is angled to be parallel to the normal of the grille frame 102. In this embodiment, the inlet side arm 12 terminates at a square corner creating end face 24.

Figure 9:
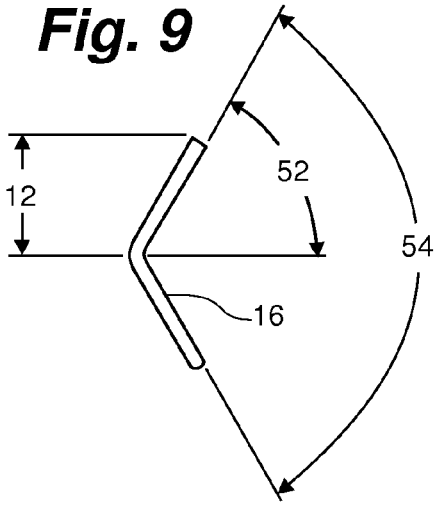
FIG. 9 is a side view of a louver.

FIG. 9 is a cross sectional view of louver 10. In this embodiment, the bend angle 52 is 60° degrees and total angle 54 of acute face 16 is 120 degrees. Inlet side arm 12 is 1.5 inches.

Figure 10:
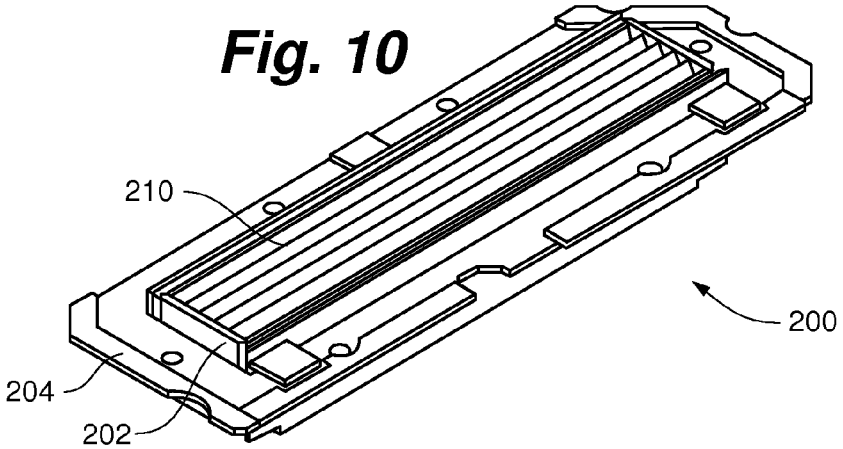
FIG. 10 is a perspective view of another embodiment of an armored grille.
Figure 11:
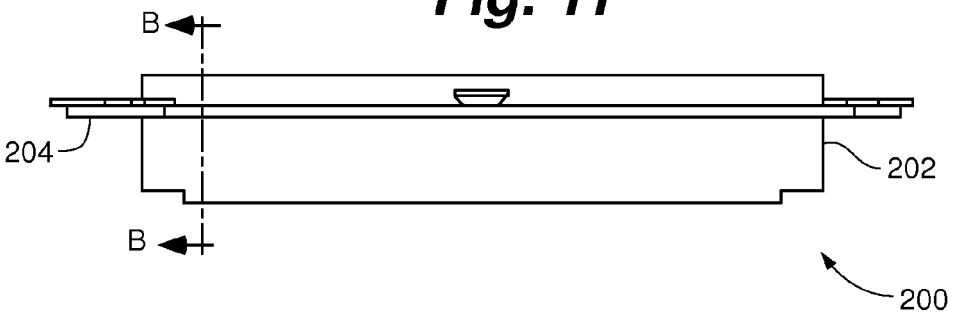
FIG. 11 is a side view of the armored grille of FIG. 10.
Figure 12:
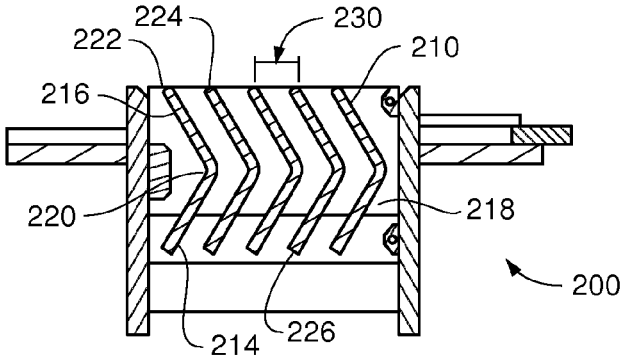
FIG. 12 is a cross sectional view of a plurality of louvers of the grille of FIG. 11 taken at line B-B.

FIGS. 10 and 11 depict perspective and side views of an alternate embodiment for air cleaner grille 200. Louvers 210 are disposed within a grille frame 202. The grille frame 202 is surrounded by a grill flange 204 which permits mounting of the grille 200 within an armored vehicle. The louvers 210 appear in parallel alignment. The louvers 210 are attached to the grille frame by welding or in the alternative, louver flanges may slidingly engage grille frame slots. The flanges may then be welded to grille frame. FIG. 12 is a cross sectional view of FIG. 11 at B-B. The louver 210 comprises inlet side arm 212, outlet side arm 214, acute face 216, obtuse face 218 and vertex 220. Only the inlet side arm 212 includes a chamfer face 222 and an end face 224. The chamfer face 222 is positioned on the acute face 216. The chamfer face 222 is angled to be parallel to the normal of the grille frame 202. In this embodiment, the inlet side arm 212 terminates at a square corner creating end face 224. Outlet side arm 214 has square end 226. The louver spacing or pitch 230 is 0.75".

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention is:

1. A ballistic grille which uses a plurality of shaped metal louvers, the metal louvers are shaped to improve air flow and ballistic protection, the ballistic grille comprising;

a grille frame;

a grille flange surrounding the grille frame, said grille flange extending from the grille frame for mounting the ballistic grille to a vehicle;

the plurality of louvers disposed within the grille frame, said louvers mounted in parallel across the length of the grille frame so that a projectile entering the ballistic grille must strike the louvers;

wherein the louvers are a continuous metal bar with an inlet side arm and an outlet side arm, the inlet side arm corresponding to the direction of a threat and the outlet side arm closer to the vehicle, said inlet side arm and outlet side arm forming the sides of an angle joined at a louver vertex, the inlet side arm having an aerodynamic shape on a leading edge of the louver and wherein the inlet side arm and the outlet side arm are made of the same material, said inlet side arm material hardened more than the outlet side arm.

2. The ballistic grille of claim 1 wherein the inlet side arm and the outlet side arm have the same length.

3. The ballistic grille of claim 1 wherein the aerodynamic shape of the leading edge of the inlet side arm of the louver is rounded.

4. The ballistic grille of claim 1 wherein the aerodynamic shape of the leading edge of the inlet side arm of the louver is chamfered, the chamfered face is angled to a closed side of the louver vertex so as to create a leading edge surface to the louver.

5. The ballistic grille of claim 4 wherein the leading edge surface of the louver is flat.

6. The ballistic grille of claim 1 wherein the aerodynamic shape of the leading edge of the inlet side arm of the louver and the outlet side arm of the louver are chamfered, the chamfered face is angled to an acute side of the louver vertex.

7. The ballistic grille of claim 1 wherein a pitch between louvers is equal to the width of the louver, the louver width defined as the perpendicular distance from the louver vertex to a line connecting the tips of the inlet side arm and the outlet side arm.

8. The ballistic grille of claim 1 wherein a pitch between louvers is less than the width of the louver, the louver width defined as the perpendicular distance from the louver vertex to a line connecting the tips of the inlet side arm and the outlet side arm.

9. The ballistic grille of claim 1 wherein an overlap between louvers is equal to the thickness of the louver at the louver vertex.

10. The ballistic grille of claim 1, said louver vertex angle is 120 degrees.

11. The ballistic grille of claim 1 wherein a honeycomb structure is attached to the grille structure.

12. A method for defeating a ballistic threat to an airhandling grille of a vehicle, the method comprising:

attaching a ballistic grille with a plurality of shaped metal louvers to the vehicle, positioning the plurality of louvers disposed within the grille, said louvers mounted in parallel across the length of the grille frame so that the ballistic threat must strike the louvers, wherein the louvers are a continuous metal bar with an inlet side arm and an outlet side arm, the inlet side arm corresponding to the direction of a threat and the outlet side arm closer to the vehicle, wherein the inlet side arm and the outlet side arm are made of the same material, said inlet side arm material hardened more than the outlet side arm; and setting a pitch between louvers that is less than the width of the louver, the louver width defined as the perpendicular distance from the louver vertex to a line connecting the tips of the inlet side arm and the outlet side arm.

13. The method for defeating a ballistic threat of claim 12, said inlet side arm further including an aerodynamically shaped leading edge.

14. The method for defeating a ballistic threat of claim 13, said aerodynamically shaped leading edge being a chamfered end.

15. The method for defeating a ballistic threat of claim 13, said aerodynamically shaped leading edge being a rounded end.

16. The method for defeating a ballistic threat of claim 12, said outlet side arm including a tapered side.

17. The method for defeating a ballistic threat of claim 12, said outlet side arm including a chamfered face.

* * * * *